United States Patent [19]

Halpenny

[11] 4,079,889

[45] Mar. 21, 1978

[54] RAILROAD TRACK RAIL

[75] Inventor: John F. Halpenny, Ottawa, Canada

[73] Assignee: The Raymond Lee Organization, Inc., New York, N.Y.

[21] Appl. No.: 656,447

[22] Filed: Feb. 9, 1976

[51] Int. Cl.[2] ..... E01B 3/38

[52] U.S. Cl. ..... 238/25; 238/7; 238/84; 238/151; 238/243

[58] Field of Search ..... 238/24, 25, 83, 84, 238/115, 139, 151, 159, 164, 168, 238, 239, 243, 249, 283, 382, 2–7, 42, 47, 85, 94; 404/17, 40, 70; 52/225, 227, 229, 723, 726

[56] References Cited

U.S. PATENT DOCUMENTS

| | | | |
|---|---|---|---|
| 950,930 | 3/1910 | Laudahn | 238/115 X |
| 1,316,645 | 9/1919 | Potenski | 238/249 |
| 1,820,911 | 9/1931 | Henderson | 238/25 X |
| 3,369,334 | 2/1968 | Berg | 52/227 |
| 3,550,850 | 12/1970 | Sonneville | 238/283 X |
| 3,687,346 | 8/1972 | Crimp et al. | 238/25 |
| 3,762,641 | 10/1973 | Schubert | 238/25 X |
| 3,907,200 | 9/1975 | Bernard | 238/283 X |
| 3,952,468 | 4/1976 | Soum | 52/227 |

FOREIGN PATENT DOCUMENTS

| | | | |
|---|---|---|---|
| 447,874 | 5/1949 | Italy | 238/238 |
| 1,033,350 | 6/1966 | United Kingdom | 238/115 |
| 1,432,565 | 4/1976 | United Kingdom | 238/7 |

*Primary Examiner*—Drayton E. Hoffman
*Assistant Examiner*—Randolph A. Reese
*Attorney, Agent, or Firm*—Howard I. Podell

[57] ABSTRACT

A rail track that reduces noise and vibration for particular use in rapid transit and subway lines. The track is formed of a conventional rail embedded in a pre-stressed concrete bed. Sections of such jacketed rails are joined together by means of flanges, one of which is welded to one side of each rail end, with the bolt holes in the flanges and the joined rails oriented at an angle to axes of the rails so as to transfer a tension load between each rail of a joint. The pre-stress tension wires of the concrete bed extend beyond the ends of each section and are individually joined by turnbuckles or other tension creating couplers. The bottom of each concrete bed section is mounted on a solid sheet of rubber or other elastomer.

1 Claim, 7 Drawing Figures

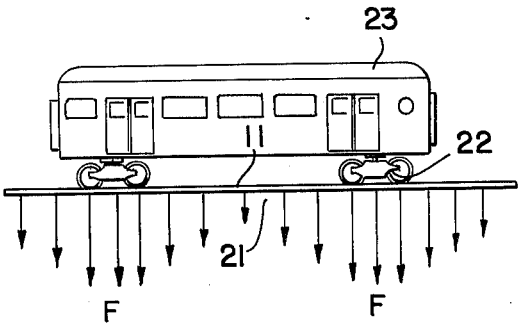
FIG. 1
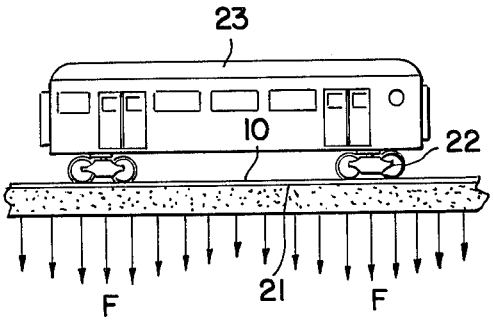
FIG. 2
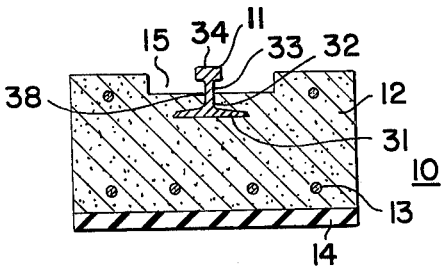
FIG. 3
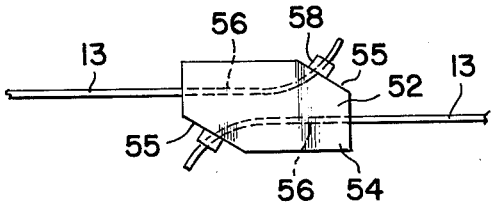
FIG. 4
FIG. 7
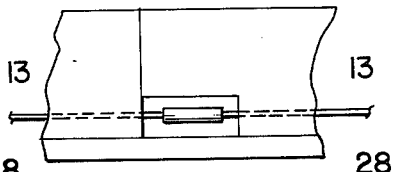
FIG. 5
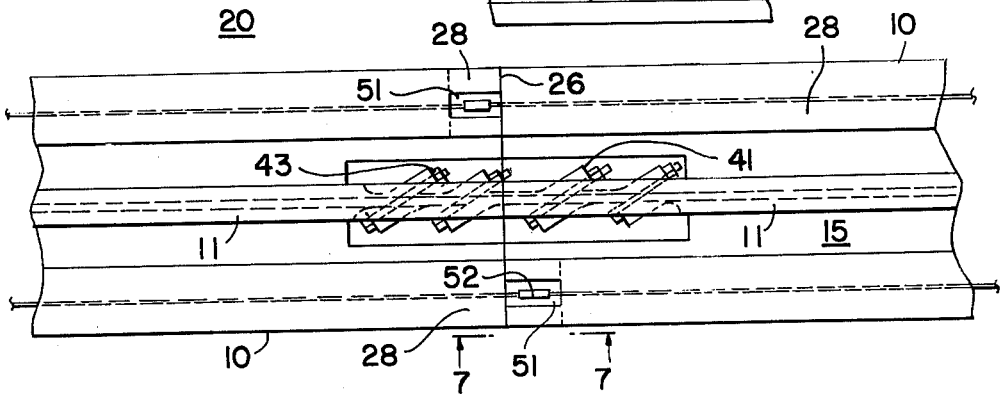
FIG. 6
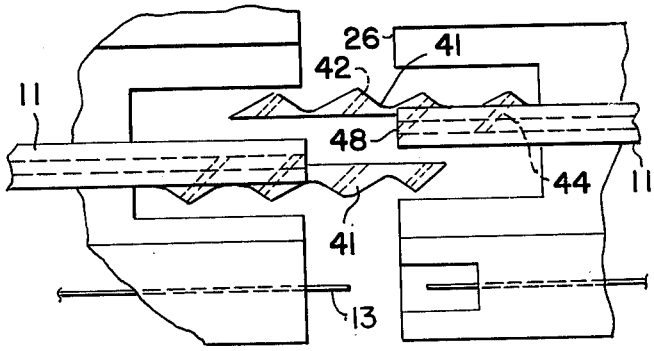

RAILROAD TRACK RAIL

SUMMARY OF THE INVENTION

My invention is a rail track that reduces noise and vibration for particular use in rapid transit and subway lines.

The track is formed of a conventional rail embedded in a pre-stressed concrete bed.

Sections of such jacketed rails are joined together by means of flanges, one of which is welded to one side of each rail end, with the bolt holes in the flanges and the joined rails oriented at an angle to axes of the rails so as to transfer a tension load between each rail of a joint.

The pre-stress tension wires of the concrete bed extend beyond the ends of each section and are individually joined by turnbuckles or other tension creating couplers.

The bottom of each concrete bed section is mounted on a solid sheet of rubber or other elastomer.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a load diagram of the vertical forces between a conventional rail and the supporting foundation;

FIG. 2 is a load diagram of the vertical forces between my improved rail and the supporting foundation;

FIG. 3 is a sectional view of a section of my improved rail;

FIG. 4 is a plan view of a pre-stress wire coupler of my invention;

FIG. 5 is a plan view of a coupled joint of two sections of my rail;

FIG. 6 is a plan view of the splice bars and rail ends of two sections of my invention; and FIG. 7 is a fragmentary side view of the bottom section of a coupled joint of my invention, taken along line 7—7 of FIG. 5.

DESCRIPTION OF THE PREFERRED EMBODIMENT

Turning now descriptively to the drawings, in which similar reference characters denote similar elements throughout the several views, FIGS. 3 and 5 indicate my improved track rail 10 which is formed as individual joined members of conventional steel rails 11, each embedded in a concrete bed and jacket 12 fitted with pre-stressed tension members 13 and mounted on a thick blanket 14 of rubber or other elastomeric material. As shown in FIG. 3, the concrete 12 is of a general rectangular cross-section encasing the bottom flange 31 and lower shank section 32 of the rail 11 with a recessed open section 15 of concrete about the top flange 34 and upper flange section 33 of the rail 11 to permit clearance of a wheel flange (not shown) on either side of the rail 11.

FIG. 1 illustrates the variation along its length of the vertical forces produced by the trucks 22 of a railroad car 23 traveling on a conventional rail 11 with the vertical lines F each indicating the magnitude of vertical force transmitted by the rail 10 to its foundation 21. FIG. 2 similarly shows the greater uniformity of vertical force transmitted under similar conditions of my improved rail 10, with the consequent reduction in noise and vibration produced by passage of railroad car 23.

Individual members 10 of my rail are joined so as to maintain a tensile force in the joined rails 11 and the pre-stressed tension members 13 of the joined members 10 in the coupled joint 20 as shown in FIGS. 4–7, with the butted end faces 26 of the concrete sections of a joint 20 maintained in compression.

Each end section 28 of a member 10 is formed with one splice bar 41 welded to one side of the shank section 38 of the rail 11 and projecting beyond the rail 11 and concrete end face 26 of the member 10. Preferably each splice bar is welded to the right side of a rail 11 as viewed away from the end face 26 so that the splice bars 41 of two adjoining rails 11 to be joined will be on opposed rail sides. Each splice bar 41 is formed with splice holes 42 oriented at an angle to the axis of the member 10 which join similarly oriented holes 44 in the rail 28 so that splice bolts 43 may be inserted in each set of aligned holes 43 and 44 at an angle to the axis of member 10 to tighten a pair of joined rails 11 in tension to create an axial compressive bearing force at the butting faces 26 of the joined concrete sections 12. To that effect the end face 26 of the concrete sections may project a specific distance beyond the end face 48 of the steel rails 11 to prevent abutting end faces 48 of the joined steel rails 11 from being in bearing.

Recessed sections 51 are similarly formed in alternate locations in the concrete end section 28 of members 10 to provide space for installing coupler units 52 to join each adjoining pair of tension members 13 in tension. Coupler units may be in the form of turnbuckles or as shown may be in the form of a block 54 with alternate opposed beveled end faces 55 formed with a pair of holes 56 that permit drawing each tension member through a hole 56 and fastening it in tension with a grip member 58 abutting a beveled end face 55.

The continuous joined track of joined sections 10 form a pre-stressed beam along its length which may be reinforced by external tension anchors to the track foundation so that the local bearing forces of wheel trucks are translated into variations of the tensile and compressive beam loads of the track to equalize the vertical forces between the track and the supporting foundation, thus eliminating the conventional noise and vibration of railroad track in use. The rubber blanket upon which the concrete is laid further reduces the noise effects of vibration.

The tension members may not be required if the steel rail 11 is pre-stressed under tension while the concrete is poured to form a track member 10, and the external sides of the portion of the rail 11 embedded in the concrete may be roughened to provide shear gripping surfaces between the pre-stressed rail and the concrete. Conventional reinforcement rods may be substituted for tension members 13 where the rail 11 carries the total tension force of the pre-stress process.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A railroad track support comprising individual modules, each module comprising a length of steel rail partially embedded in a concrete bed which extends in the axial direction of the rail; first and second joint means which join two such modules along a common axial orientation so that the end faces of the concrete beds of two such joined modules detachably abut directly against each other and so that said joined modules transmit both compression and tension axial forces as a unit; said first joint means comprising two splice bars, one each on opposite sides of the rails of two axially abutting modules, said splice bars formed with splice holes, the axes of which are oriented at a diagonal angle to the axis of the joined rails when a pair of said splice bars are bolted about two such joined rails, said diagonal axes of the splice holes permitting each bolt fastened through said splice bars to apply an axial tension load to the joined rails, and an axial compressive load to the abutting concrete beds, with said rails being shorter in length than the overall length of the concrete beds of the modules, so that the opposed end sections of the concrete beds extend beyond the respective end sections of the steel rails;

each said concrete bed encasing longitudinal tension members;

each said concrete bed formed on each end with one or more open recesses extending from the end face of each said end, with a first set of said tension members extending beyond the said end faces and a second set of said tension members extending into said open recesses, said recesses oriented so that when two such modules are joined in abutting relationship along a common longitudinal axis, each of the second set of tension members of each module extends into said recess of the other module;

said second joint means comprising fastening means, each of a size to fit into a said recess, for joining together under an adjustable tension force, the two tension members of two abutting modules which extend into a common said recess so as to draw the two modules together to provide a pre-set axial compression force in the concrete beds of the two modules.

* * * * *